United States Patent [19]

Pulte

[11] 4,015,385

[45] Apr. 5, 1977

[54] HOUSE WITH UNFINISHED BONUS SPACE

[76] Inventor: William J. Pulte, 1505 Kirkway Drive, Bloomfield Hills, Mich. 48013

[22] Filed: June 2, 1975

[21] Appl. No.: 582,679

[52] U.S. Cl. ..... 52/236

[51] Int. Cl.[2] ..... E04H 1/04

[58] Field of Search ..... 52/234, 236

[56] References Cited

OTHER PUBLICATIONS

Home Planners Inc., vol. 4, pp. 10, 81, 106, Richard Pollman Designer, 1974.

101 Home Plans, Fall 1974, vol. 2, No. 3 by Davis Publications, p. 44.

Home Planners Inc., 1974, 1½ and Two Story Designs, vol. 1, Richard B. Pollman (Designer), pp. 20, 45, 47, 51, 53.

Home Planners Inc., 1974, Multi-Level Designs, vol. 4, Richard B. Pollman (Designer), pp. 7, 11, 14, 30, 36, 42, 59, 84, 91, 95.

*Primary Examiner*—John E. Murtagh

[57] ABSTRACT

A rectangular two-story house having the entire exterior as well as the central and one side interior portion finished with complete living quarters including all normal accommodations for initial family occupancy, the other side having a built-in garage, adjacent room space, and second floor overlying same providing unfinished room space adapted with roughed in facilities for optional future completion to finished rooms. A common two-story full length rectangular shell for the entire house together with the arrangement of unfinished room space in relation to the built-in garage provide a potential and many options for substantial economical future expansion at minimal initial and ultimate cost.

9 Claims, 6 Drawing Figures

HOUSE WITH UNFINISHED BONUS SPACE

BACKGROUND OF THE INVENTION

House expansion by remodelling with the add-on of wings or rooms, completion of basement recreation rooms or attic rooms is of course well known. The closest known prior art was widely built beginning several decades ago in the "bungalow" form having a finished first floor for initial occupancy with a high pitched roof providing an unfinished attic for second floor future room space. The need for a more adequate solution to home expansion problems has existed for many years and become increasingly important with accelerating costs of building, high home loan interest rates and depressed new and used housing sales. Home builders have been faced with the dilemma of conventional construction costs exceeding the reach of the market. Growing families with the need for supplemental accommodations have been forced to resort to small initial homes which are rapidly outgrown; and are then confronted with excessive costs in attempting to remodel or in transferring to larger homes in which the total price reflects the uninterrupted inflation of the intervening years.

SUMMARY OF THE PRESENT INVENTION

The present invention was developed to provide a more adequate answer to the long existing need for expansion housing with the following basic objectives: maximum potential for substantially expanded future accommodations; minimum additional initial cost beyond the normal cost of a conventional house providing equal finished accommodations; a sufficient provision of flooring, roughed-in plumbing, heating facilities, and other expedient preparations to facilitate future completion efficiently and at minimal cost; maximum options for alternative future accommodations in the available unfinished space to meet the particular needs of the family as they evolve or change after the time of initial purchase. The basic key in meeting these objectives was found to reside in the provision and arrangement of unfinished "bonus space" for future rooms in relation to a built-in garage and finished portions of the house and primarily in utilizing a wide open floor structure overlying the garage and adjacent first floor room space to provide a large unbroken second floor space suitable for finishing through partitioning into several rooms of optional configuration, including additional bath facilities. In the embodiments illustrated herein, and alternative modifications thereof, the first floor room adjacent to the garage underlying such second story floor is likewise unfinished and of adequate size for future completion as a family room, library, recreation room, shop, laundry or the like. The roughed in facilities are adapted to permit completion with little or no remodeling or additional cost incident to postponing completion. Any intervening inflationary factors are thus limited to the building materials and labor which are employed in the completion per se, and such may be greatly, entirely or more than offset by the homeowner's own manual contribution to the completion which may be conveniently performed in spare time on a "handy man" basis.

DESCRIPTION OF THE DRAWINGS

With reference to FIG. 1 it will be seen that the exterior of the house is completely finished and comprises a generally rectangular two-floor structure, including a main central and side portion A, which has finished interior rooms, and a side portion B which includes a built-in two-car garage 10 adjacent to a first floor unfinished front room 11 and a second story unfinished room space 12 overlying the garage 10 and first floor unfinished room 11. As shown in FIG. 2 a second story floor structure 13 extends from front to back without partitioning over the entire side of the house to the right of the main partition wall 14 and can be suitably finished at any future time with optional placement of internal wall partitioning in any manner that suits the ultimate requirements of the home owner. Rough plumbing for a second bathroom 15 adjacent an initially finished bath 16 facilitiates future completion with minimal cost for extending the plumbing facilities to serve both bathrooms. A doorway 17*a* closing off the unfinished bonus space from the remainder of the house may be used as an entrance to a hallway 18 serving the respective rooms, as ultimately partitioned.

Figure 1:
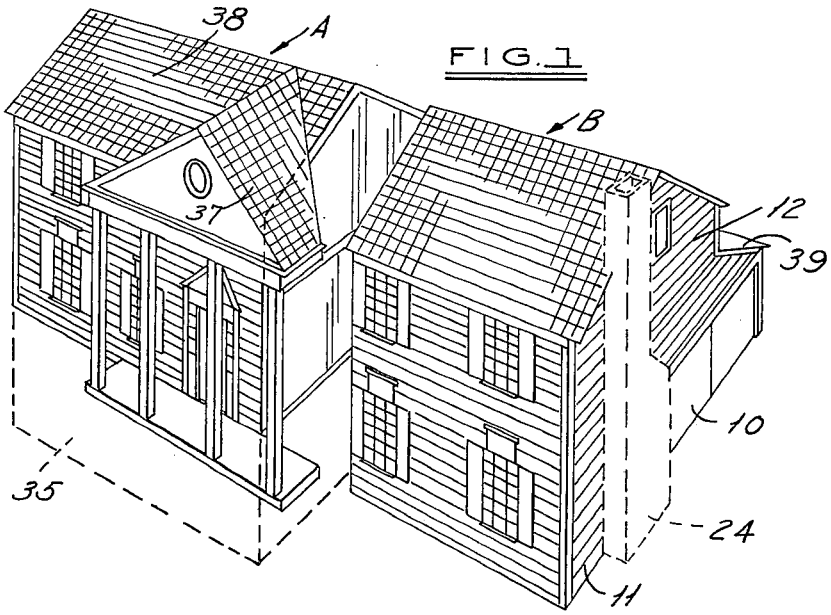
FIG. 1 is a perspective view of one embodiment of a house constructed in accordance with the present invention showing that portion incorporating the unfinished room space and garage separated from the completely finished portion of the house.

The floor structure 13 overlies that portion of the garage within the rectangular confines of the second floor as well as the unfinished "bonus space" room 11 in front of such garage. A main floor extension 20 of the garage beyond the back wall 21 of the house assures adequate floor space for two cars together with ample unfinished bonus space for a large future room 11 such as a family or recreation room. The first floor for the garage and unfinished bonus space is preferably constructed of poured concrete over an unexcavated foundation with a parking area 22 and a walking or storage space 23. As initially constructed, the garage optionally may be partitioned at 19 from the bonus space 11.

Roughed-in framing for optional first and/or second floor fireplace installations 24 and 25 may be included in the internal sidewall 26 and 27 as well as roughed-in framing for optional windows 28 on the second floor. A furnace adequate for heating the entire house when completely finished is preferred in the initial installation as well as optional roughed in heating provisions for the second floor unfinished bonus space and completed heating provisions for the first floor unfinished bonus space when a concrete floor is used, in order to minimize completion costs.

Figure 2:
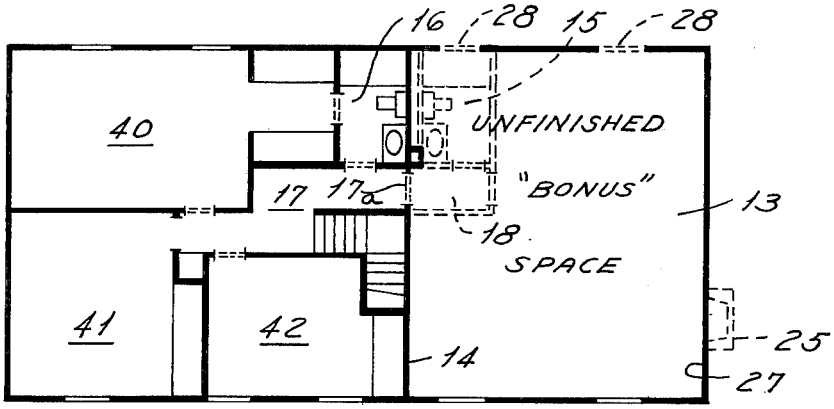
FIG. 2 is a floor plan view of the second floor of the house illustrated in FIG. 1.

The initially finished interior of the main portion A provides complete living quarters for initial occupancy including on the first floor a large combination living-dining room 29, kitchen 30, with breakfast nook 31, powder room 32, entrance foyer 33 and stairway 34 to the second floor. As shown in FIG. 2 the second floor includes a master bedroom 40, two additional bedrooms 41, 42, and a full bath 16 as well as a hall 17 and suitable closet space. A full basement 35 is preferably provided under the entire A portion of the house entered from a downward stairway 35*a*.

A decorative four-pillar front verandah 36 with a peaked roof 37 provides a gracious colonial house entrance facade as one of many optional front elevations. The main roof 38, as illustrated in FIG. 1, extends over the complete length of the house, including portions A and B, for maximum economy of initial construction including coverage of the bonus space. The parallel roof 39 over the garage extension 20 provides the only structural departure from the economical two-floor rectangular wall construction and even this extension may be omitted in the case of a one-car garage.

Figure 4:
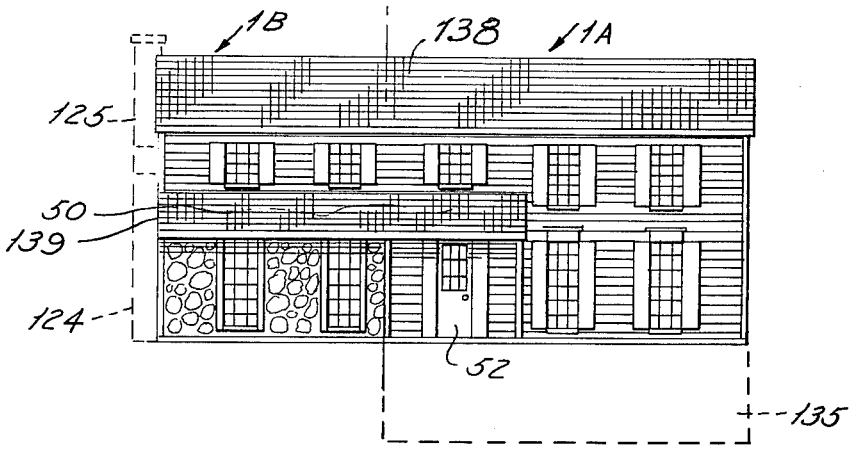
FIG. 4 is a front elevation of a modified house constructed in accordance with the present invention.
Figure 5:
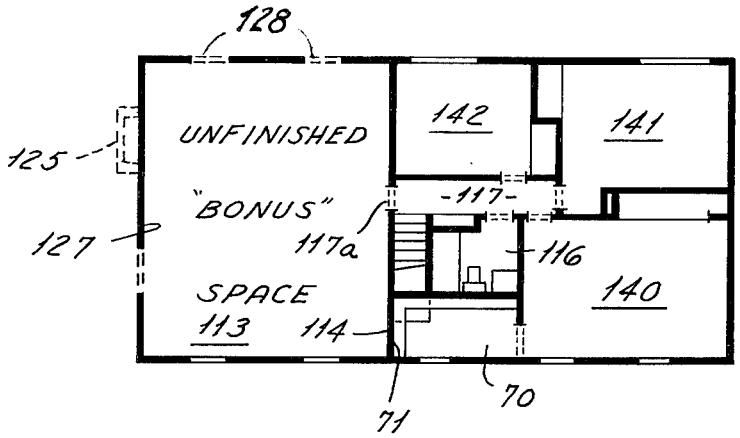
FIG. 5 is a floor plan view of the second floor of the house illustrated in FIG. 4.
Figure 6:
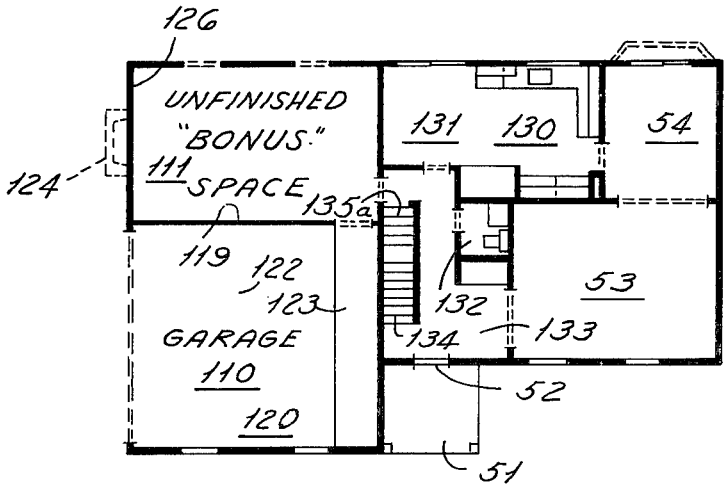
FIG. 6 is a floor plan view of the first floor of the house illustrated in FIG. 4.

With reference to FIGS. 4, 5, and 6, an alternative construction is shown with the garage and unfinished "bonus space" on the left side of the house, wth the garage extension at the front instead of the rear, and with a somewhat modified floor plan for the initially completed portion of the house. Corresponding elements are identified with a numeral 1 prefix relative to those of the first embodiment and the description thereof may thereby be applied. Additional distinctive features of the modified construction include an extension of the garage roof 139 to provide a porch cover 50 for a front porch 51 and the front entrance door 52. Somewhat different initially finished floor plan arrangements are shown including a living room 53, at the front of the house, a dining room 54, kitchen 130, and a breakfast nook 131 at the rear. In addition, a straight up stairway 134 is provided instead of an angle stairway from an intermediate landing as in the first embodiment.

In the second floor plan of the modified embodiment shown in FIG. 5 an initial large closet 70 for the master bedroom 140 may be adapted with rough plumbing for an optional second bath with a roughed-in door frame at 71 which may be opened into one of the unfinished bonus space rooms upon future completion.

It will be understood that these two embodiments are illustrative of a number of optional alternatives which will readily occur to those skilled in the art to suit the particular lot and front and back yard vistas. For example, either embodiment may be reversed to put the garage and unfinished bonus space on the other side. Likewise, with only slight modification, the garage extension may be located at either the front or back of the house and the unfinished adjacent bonus space correspondingly at the back or front. In addition, the first floor of the second embodiment, as shown in FIG. 6, may be combined with the second floor of the first embodiment, as shown in FIG. 2, subject to reversing the left and right sides of one of the embodiments and modifying the floor plan of FIG. 2 to accept the straight stairway 134 of FIG. 6.

The resulting combination of the second floor of the first embodiment with the first floor of the second embodiment has in practice actually proved to be the preferred embodiment, although the three basic models each have distinct advantages for particular locations, depending on vistas, neighboring houses, and the like.

It will be understood from the foregoing description that in a house so constructed and providing, for example, an ultimate building space, excluding garage and basement, in the order of 2,400 or 2,500 square feet, approximately one-third of such space may be unfinished at time of initial occupancy while nevertheless qualifying for the full square foot area under most subdivision restrictions or zoning ordinances specifying minimum sizes. It will also be seen that the house may be initially occupied with the complete living accommodations of a conventional three-bedroom house in no way inpaired in function or appearance by the unfinished portion. In fact, the totally finished exterior of the much larger house provides a distinct bonus in appearance from the outset. The unique arrangement of the unfinished bonus space, and particularly the wide open second floor overlying the garage and adjacent first floor room space all located within a rectangular housing common to the entire house provide a highly economical approach to creating a large proportion of unfinished bonus space at a minimum of extra cost compared to a conventional completed house without such bonus space.

Figure 3:
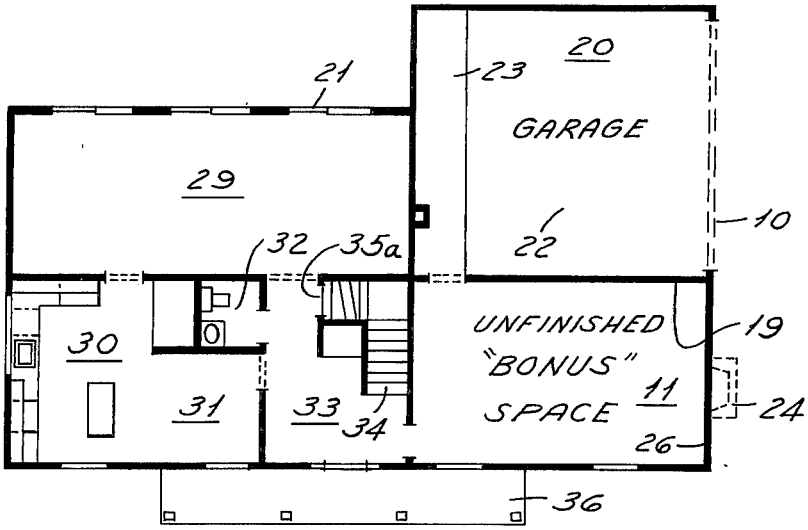
FIG. 3 is a floor plan view of the first floor including a built-in two-car garage.

The economics of the construction may be illustrated from actual selling prices prevailing at the time of filing this application. Thus, the selling price of the first 2,500 square foot embodiment with unfinished bonus space as indicated by FIGS. 1–3 on a basic 85 × 175 foot lot is $56,000; the selling price of the modified 2,400 square foot embodiment of FIGS. 4–6 is $55,000; the selling price for typical completion of either embodiment is approximately $10,000 as follows:

$125.00—insulating upper"bonus" space floor
$225.00—insulating upper "bonus" space ceiling and walls
$2,500.00—single fireplace on either first or second floor
$790.00—second fireplace
$275.00—finish heating upper bonus space
$1,500.00—completing second bath
$1,100.00—completing fourth upstairs bedroom
$2,100.00—completing fifth upstairs bedroom
$170.00—installation of two windows
$1,200.00—finishing downstairs family room Comparable expansion of a conventional completed home would cost at least in the range of $20–25,000 while the cost of a complete comparable house excluding the unfinished bonus space of the disclosed embodiments would save no more than approximately $2,500.00. Any future inflation would apply only to the $10,000.00 cost of completion of any of the disclosed embodiments whereas the inflationary increase for building an entire house of comparable final size would be more than five times as much while the additional inflationary cost of conventional remodelling of a corresponding smaller house would be compounded by the multiple of its inherently higher basic cost. Thus, it is believed clear that the present invention provides a substantial solution to the dilemma of inflationary building costs coupled with expanding housing requirements for typical growing families and financial resources.

I claim:

1. A house comprising;

a two story generally rectangular finished exterior shell, a central entrance in one of the longer side exposures of said rectangular shell, a vertical wall structure extending between said longer side exposures at one side of said entrance dividing the house into two major internal two-story portions of comparable size, the portion having said entrance being finished with complete initial living quarters including living, kitchen, eating, multiple bedroom, closet, bath, hall and stairway accommodations, the other portion including a built-in garage (bounded by at least two interior walls), and adjacent unfinished first floor room space, floor structure overlying both said garage and adjacent first floor room space for unfinished second floor rooms adjacent said vertical wall structure, and provisions including means for convenient utility connections facilitating optional future completion of said other portion to include desired supplemental finished rooms on both stories.

2. A two-story house as set forth in claim 1 wherein said finished and unfinished interior portions are enclosed within a single common rectangular finished exterior shell covered by a common continuous roof.

3. A two-story house as set forth in claim 2 wherein said garage comprises a two-car garage ncluding in part a single floor extension from said rectangular finished exterior shell and having a roof covering said extension.

4. A two-story house as set forth in claim 1 including roughed in plumbing and heating provisions for said second floor unfinished rooms.

5. A two-story house as set forth in claim 1 including roughed in plumbing and heating provisions for said second floor unfinished rooms and a furnace of adequate capacity to heat the entire house including all rooms when finished.

6. A two-story house as set forth in claim 1 including rough framing for future installation of supplemental windows in the finished exterior of said unfinished rooms.

7.A two-story house as set forth in claim 1 including roughed in future fireplace framing provisions in at least one of said unfinished rooms.

8. A two-story house as set forth in claim 1 including a basement underlying said finished interior portion.

9. A two-story house as set forth in claim 1 including finished second floor hallway access to said unfinished second floor rooms.

* * * * *